US009750966B2

(12) United States Patent
Qiang et al.

(10) Patent No.: US 9,750,966 B2
(45) Date of Patent: Sep. 5, 2017

(54) FIXED FIRE EXTINGUISHING APPARATUS

(75) Inventors: Jian Qiang, Xi'an (CN); Zhengjun Lei, Xi'an (CN)

(73) Assignee: XI'AN WESTPEACE FIRE TECHNOLOGY CO., LTD, Shaanxi (CN)

( * ) Notice: Subject to any disclaimer, the term of this patent is extended or adjusted under 35 U.S.C. 154(b) by 397 days.

(21) Appl. No.: 14/367,371

(22) PCT Filed: Aug. 16, 2012

(86) PCT No.: PCT/CN2012/080223

§ 371 (c)(1),
(2), (4) Date: Jun. 20, 2014

(87) PCT Pub. No.: WO2013/091386

PCT Pub. Date: Jun. 27, 2013

(65) Prior Publication Data

US 2015/0321034 A1 Nov. 12, 2015

(30) Foreign Application Priority Data

Dec. 20, 2011 (CN) ..... 2011 1 0453959

(51) Int. Cl.
*A62C 35/00* (2006.01)
*A62C 35/13* (2006.01)
(Continued)

(52) U.S. Cl.
CPC ..... *A62C 35/13* (2013.01); *A62C 3/16* (2013.01); *A62C 35/023* (2013.01); *A62C 37/40* (2013.01); *A62C 99/0045* (2013.01)

(58) Field of Classification Search
CPC ..... A62C 35/00; A62C 35/02; A62C 35/023; A62C 35/08; A62C 35/20; A62C 37/40; A62C 13/78; A62C 99/0045
(Continued)

(56) References Cited

U.S. PATENT DOCUMENTS 252,678 A * 1/1882 Kitsee ..... A62C 35/023 169/7
467,142 A * 1/1892 Singer ..... A62C 35/023 137/505.22
(Continued)

FOREIGN PATENT DOCUMENTS

CN 101682186 A 3/2010
CN 201815031 U 5/2011
(Continued)

OTHER PUBLICATIONS

Supplemental European Search Report Application No. EP12858942; dated Oct. 14, 2015; pp. 5.
(Continued)

*Primary Examiner* — Alexander Valvis
(74) *Attorney, Agent, or Firm* — Cantor Colburn LLP

(57) ABSTRACT

A fixed fire extinguishing apparatus, comprising a housing (2), a cartridge (1) and an activation controller connected to the cartridge (1), wherein the cartridge (1) is numbered at least two and arrayed in the housing (2), a bottom of the cartridge penetrates through the fixing hole and extends to a bottom of the bracket, the fixing device comprises a bolt fixed at the bottom of the cartridge, a nut matched with the bolt, a rotation-stopping main body is clamped directly to the bottom of the bracket and a bump fixed on the rotation-stopping main body (3-1) and clamped with the bolt; a through groove is provided on the bolt, a through-direction of the through groove is perpendicular to the extending direction of an axis of the bolt the bump can be embedded in the through groove.

7 Claims, 5 Drawing Sheets

(51) Int. Cl.

| | |
|---|---|
| ***A62C 35/02*** | (2006.01) |
| ***A62C 3/16*** | (2006.01) |
| *A62C 37/40* | (2006.01) |
| *A62C 99/00* | (2010.01) |

(58) Field of Classification Search
USPC ..... 169/51
See application file for complete search history.

(56) References Cited

U.S. PATENT DOCUMENTS

| | | | | | |
|---|---|---|---|---|---|
| 1,315,522 | A * | 9/1919 | Maxwell | A62C 35/023 | 169/10 |
| 3,878,896 | A * | 4/1975 | White | A62C 35/02 | 169/88 |
| 5,071,100 | A * | 12/1991 | Sweeny | A62C 13/78 | 248/310 |
| 8,413,732 | B2 * | 4/2013 | Richardson | A62C 35/02 | 169/28 |
| 2003/0062175 | A1 * | 4/2003 | Olander | A62C 5/00 | 169/51 |
| 2009/0260839 | A1 * | 10/2009 | Itano | A62C 13/66 | 169/85 |
| 2010/0170684 | A1 * | 7/2010 | Richardson | A62C 35/02 | 169/46 |
| 2013/0284465 | A1 * | 10/2013 | Broidy | A62C 35/023 | 169/51 |

FOREIGN PATENT DOCUMENTS

| | | | | |
|---|---|---|---|---|
| CN | 301762072 | S | 12/2011 | |
| CN | 202236991 | U | 5/2012 | |
| CN | 202398009 | U | 8/2012 | |
| EP | 0882470 | A2 | 12/1998 | |
| JP | 52041451 | * | 9/1975 | F16B 39/12 |
| JP | 8252338 | A | 10/1996 | |
| WO | 2013044749 | A1 | 4/2013 | |

OTHER PUBLICATIONS

International Search Report dated Nov. 15, 2012 re: PCT/CN2012/080223; citing: CN301862072S, CN101682186A, CN201815031U, JP8252338A and CN202398009U.

* cited by examiner

FIXED FIRE EXTINGUISHING APPARATUS

TECHNICAL FIELD OF THE INVENTION

The present invention belongs to the technical field of fire prevention, and particularly relating to a fixed fire extinguishing apparatus.

BACKGROUND OF THE INVENTION

Fires usually cause significant loss of life and property and appropriate fire fighting apparatuses are necessary to eradicate fires from the beginning. Different fire fighting apparatuses are required in different places. In the modern working and living environment, common fire extinguishing apparatuses can solve the problem of fire extinguishment effectively in relative narrow sites including transport vehicles, electronic devices, household appliances and kitchens etc. However, a fixed fire extinguishing apparatus with a relatively small volume is more appropriate in a relatively narrow and small space, e.g. a space of 3 to 15 cubic meters, including application places like a power distribution cabinet and a small unattended base station etc. Such a fixed fire extinguishing apparatus is generally provided with a cartridge in a housing 2, and an agent of the cartridge is ignited by an activation controller to burn to release a hot aerosol fire extinguishing gas, thus realizing fire extinguishment.

However, because of the limited fire extinguishing ability of a single cartridge, the problem of incomplete fire extinguishment at a dead angle of a protected space is usually caused during fire extinguishment. In addition, an existing fixed fire extinguishing apparatus fixes a cartridge by filling silica gel in a cavity between a housing and the cartridge to prevent the cartridge from oscillating in the housing, which will affect the fire extinguishing performance of an agent. In addition, the next process needs to be performed after standing the filled silica gel for 7 to 8 hours to be solidified. Thus, a large working site is required by the standing. Therefore, the method of fixing the cartridge by filling silica gel is extremely inconvenient, requires complex production techniques, occupies large production sites, and results in high production costs and low efficiency.

SUMMARY OF THE INVENTION

To solve disadvantages existing in an automatic fixed fire extinguishing apparatus in the prior art, the present invention provides a fixed fire extinguishing apparatus capable of activating a plurality of cartridges simultaneously and capable of being fixed reliably with good fire extinguishing performance.

The present invention applies the following technical solution to solve the technical problem:

a fixed fire extinguishing apparatus, comprising a housing, a cartridge and an activation controller connected to the cartridge; the cartridge is numbered at least one and arrayed in the housing.

A bracket configured to support the cartridge is further provided in the housing of the present invention; the top of the bracket is provided with a fixing hole matched with the structure of the outer wall of the cartridge; the bottom of the cartridge penetrates through the fixing hole and extends to the bottom of the bracket.

Further, the top of the housing is provided with a counter bore; the spraying end of the cartridge extends into the counter bore; the bottom of the cartridge is fixedly connected with the bracket through a fixing device.

Further, the fixing device comprises a bolt fixed at the bottom of the cartridge, a nut matched with the bolt, a rotation-stopping main body capable of being clamped with the bottom of the bracket and a bump fixed on the rotation-stopping main body and clamped with the bolt.

Further, a through groove is provided on the bolt in the radial direction; the bump can be embedded in the through groove.

Further a groove is provided on the side wall of the bolt and the groove is matched with the bump.

Further, a screw hole corresponding to the bolt is provided at the bottom of the bracket and the screw hole is clamped with the rotation-stopping main body.

Further, the rotation-stopping main body is integrated with the bottom of the bracket.

A spraying window may be further provided at the front side wall of the housing of the present invention; a filter net is provided on the spraying window; a deflecting plate extending to the spraying window is provided above the spraying end of the cartridge.

Further, the outer wall of the cartridge is fixedly connected with the bracket by filling a silica gel liquid.

The activation controller of the present invention is provided at the bottom of the housing and connected with an ignition head of the cartridge through a conductor.

Further, the side wall of the bottom end of the housing is provided with a moveable gate; the moveable gate faces the activation controller in the housing.

There are 3 to 20 cartridges in the present invention.

The fixed fire extinguishing apparatus of the present invention mainly has the following advantages:

1. a plurality of cartridges are provided in the same housing according to the present invention, and are controlled to be activated simultaneously by the same controller; in addition, the number of the cartridges may be selected according to the size of a space, thus providing the maximum fire protection ability while saving space;

2. by providing the fixing device according to the present invention, i.e. by the interaction among the bolt, the rotation-stopping main body, the bump and the housing groove, one end of the bolt connected with the cartridge is fixed and the nut outside the bottom of the housing of other end of the bolt is tightened to fix the cartridge and the bottom of the bracket, thus ensuring that the cartridge is well secured and realizing simple operation; it is unnecessary to fill and stand silica gel, thus a production site is saved, assembly processes are smooth, production efficiency can be improved and production cost can be saved;

3. the present invention applies the bracket to fix the cartridge, thus preventing the cartridge from oscillating in the housing to affect the fire extinguishing performance of the cartridge;

4. the present invention may further enable a hot aerosol sprayed by the cartridge to be deflected and sprayed from the spraying window through the filter net provided at the spraying window and the deflecting plate provided above the cartridge to extinguish a fire, thus greatly improving the fire extinguishing efficacy of the fire extinguishing apparatus; in addition, residues generated after combustion of an agent are intercepted by being filtered by the filter net, thus preventing corrosion or other damage on an electric device etc. of a protected area.

DETAILED DESCRIPTION OF THE INVENTION

A fixed fire extinguishing apparatus of the present invention will be further described in combination with the accompanying drawings.

Embodiment 1

Figure 1:
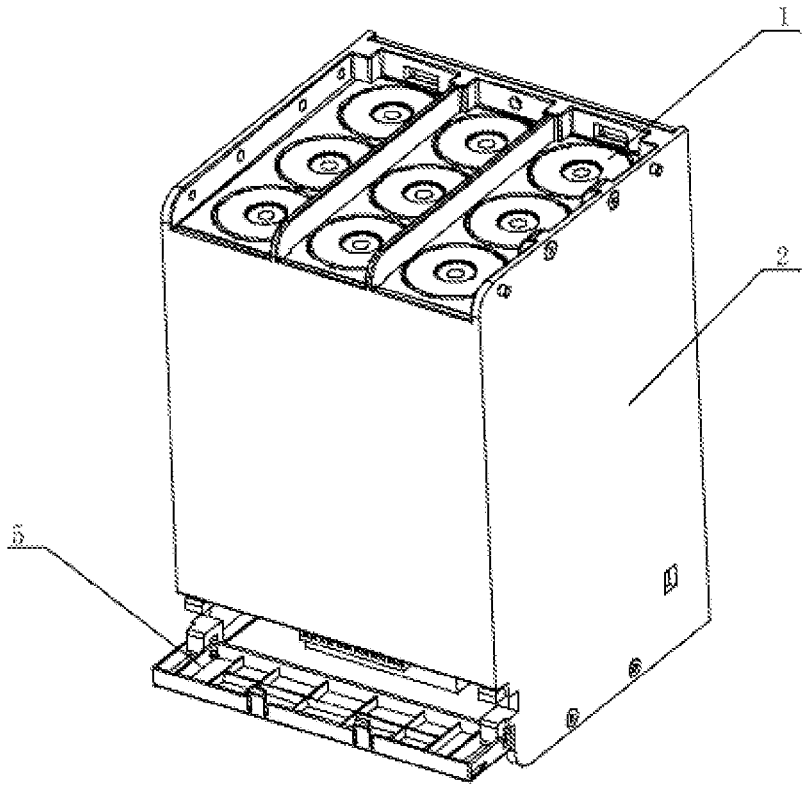
FIG. 1 is a structural diagram of the first embodiment of the present invention.
Figure 2:
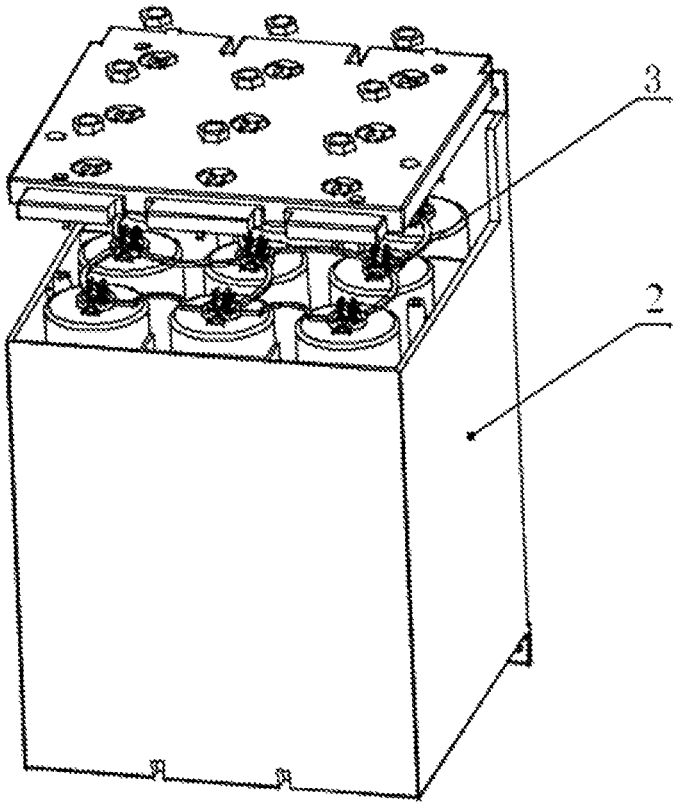
FIG. 2 is a schematic diagram illustrating installation of the first embodiment of the present invention.

Referring to FIG. 1 and FIG. 2, the novel fixed fire extinguishing apparatus is mainly structured by connecting cartridges 1, a housing 2, a fixing device 3 and a bracket 4.

The housing 2 of the present embodiment applies an integral structure and is made of a plastic material. A counter bore is provided at the top of the housing 2. The bracket 4 is provided in the housing 2. Nine fixing holes structurally matched with the cartridges 1 are provided at the top of the bracket 4 and fixedly connected with the housing 2 through a bolt 3-3 at the back side wall of the bracket 4. Nine cartridges 1 are inserted into the fixing holes in parallel. The bottoms of the cartridges 1 extend to the bottom of the bracket 4 to be fixed through a fixing device 3 and the tops of the cartridges 1, i.e. the spraying ends, extend into the counter bore in the housing 2. The cartridges 1 of the present embodiment may apply an cartridge 1 structure in the prior art, mainly comprising a fireworks agent, an ignition head, a coolant, a honeycomb cooling layer, a trumpet nozzle provided in turn in a cartridge 1 and an insulating layer provided between the fireworks agent and the cartridge body. The top end of the cartridge 1 is covered by a cartridge cap, thus realizing assembly of the cartridge 1. The cartridge 1 realizes fire extinguishment mainly by igniting the fireworks agent so that the fireworks agent releases a hot aerosol fire extinguishing gas which is supported to combust and to be cooled by the coolant to be sprayed safely from a nozzle of the cartridge 1. The number of the cartridges 1 in the housing 2 may be selected according to the dose of the agent and requirements of an application environment. However, the number of cartridges is preferably 9 in a relatively close space of 30 to 160 cubic meters.

An activation controller is further provided below the cartridges 1 in the housing 2 of the present invention. The activation controller is mainly composed of a battery, a control circuit board and a battery fixing plate. The control circuit board is connected with the battery and installed on the battery fixing plate. The ignition output end of the control circuit board is connected with the ignition heads of the cartridges 1 through conductors. The grains in the cartridges 1 are ignited by the activation controller to spray a fire extinguishing agent to extinguish a fire. A rotational moveable gate 5 is provided on the bottom of the housing 2 facing to the side wall of the activation controller and is fixedly connected with the housing 2 through a rotating shaft, thus facilitating adjustment of the activation controller.

Figure 3:
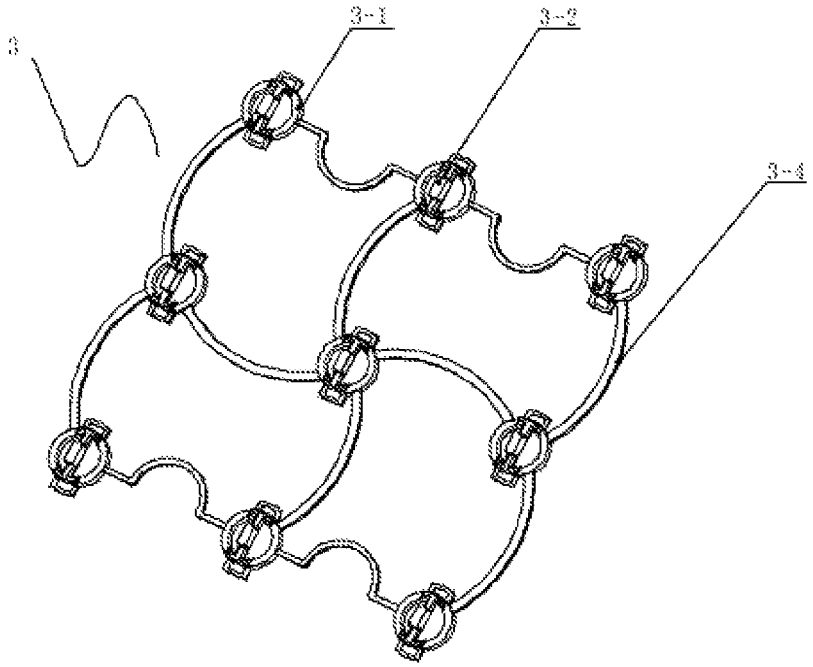
FIG. 3 is a structural diagram of a rotation-stopping main body in FIG. 1.
Figure 4:
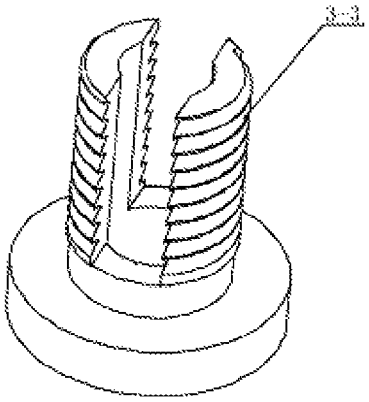
FIG. 4 is a structural diagram of a bolt in FIG. 1.
Figure 5:
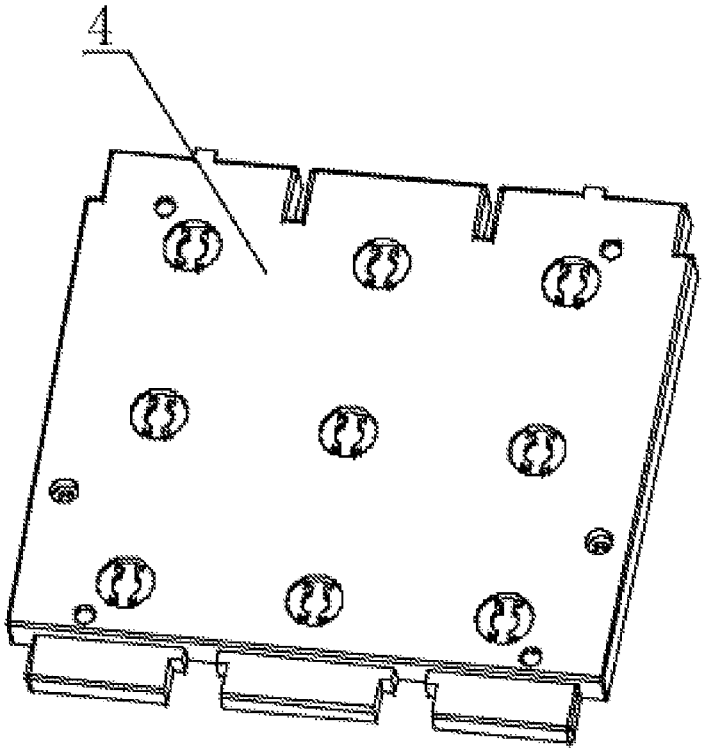
FIG. 5 is a structural diagram of the bottom of a bracket in FIG. 1.

Referring to FIG. 3, FIG. 4 and FIG. 5, the fixing device 3 is mainly composed of a bolt 3-3, a nut matched with the bolt 3-3, a rotation-stopping main body 3-1 and a bump 3-2, wherein the bolt 3-3 is connected to the bottoms of the cartridges 1 and may be fixed to the bottoms of the cartridges 1 by means of welding, or may also penetrate through the bottoms of the cartridges 1 from the interiors to the exteriors to be fixed. In addition, a through groove is provided in the radial direction of the bolt 3-3 to be clamped with the bump 3-2. A screw hole corresponding to the bolt 3-3 is provided at the bottom of the bracket 4 and the shape of the screw hole is matched with the structure of the rotation-stopping main body 3-1 so that the rotation-stopping main body 3-1 is embedded therein without rotation. Multiple rotation-stopping main bodies 3-1 are connected integrally through connecting rings 3-4. The bump 3-2 is provided on the rotation-stopping main bodies 3-1 and may be embedded into the through groove of the bolt 3-3, and the bolt 3-3 penetrates through the rotation-stopping main bodies 3-1 to extend out of the screw hole. The nut is tightened to complete assembly. When the nut is tightened, the rotation-stopping main bodies 3-1 are clamped by the screw hole to prevent rotation, while the bump 3-2 embedded into the through groove of the bolt 3-3 is limited by the rotation-stopping main bodies 3-1, thus preventing rotation, i.e. limiting the bolt 3-3 from rotating. The nut is tightened to fix the cartridges 1 and the housing 2. The number of the fixing devices 3 corresponds to that of the cartridges 1.

Embodiment 2

Figure 6:
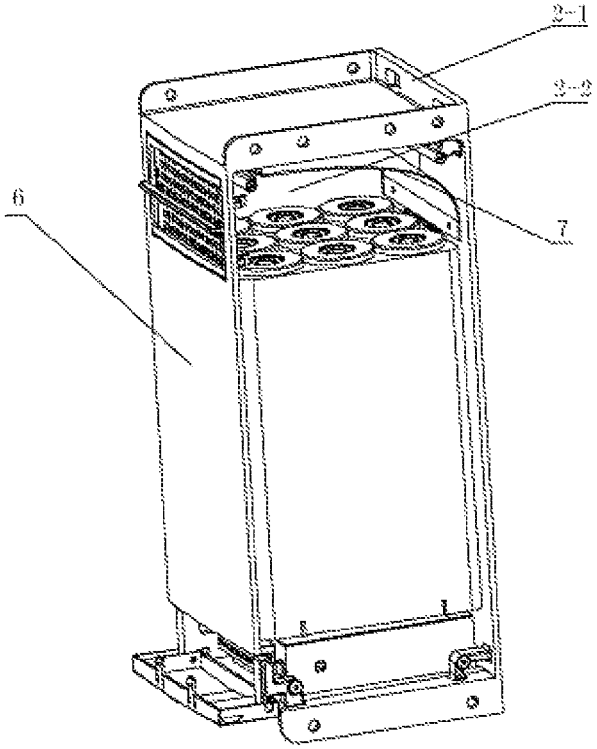
FIG. 6 is a structural diagram of the second embodiment of the present invention.

Referring to FIG. 6, a housing 2 of the present embodiment may be shaped by die-casting aluminum, or may also apply die-casting aluminum partly to realize good cooling effect. The housing 2 includes a main body 2-1. Two side faces of the main body 2-1 are respectively installed with a lateral plate 2-2. The lateral plates 2-2 are fixed with the main body 2-1 by bolts and can be detached, thus facilitating installation. The front of the main body 2-1 is provided with a spraying window. A filter net 6 may be installed on the spraying window. A cartridge 1 is installed in the housing 2 and supported by a bracket 4. In addition, silica gel is filled in a cavity between the bracket 4 and the cartridge 1 so as to realize complete fixation and prevent oscillation. A deflecting plate 7 is provided above the cartridge 1. The deflecting plate 7 extends to the spraying window to guide a hot aerosol gas sprayed by the cartridge 1 to be sprayed from the spraying window to extinguish a fire.

Other components and connection relations are the same as those of the first embodiment.

Embodiment 3

A housing 2 of the present embodiment is provided with 3 cartridges 1 and 3 fixing holes are provided on a bracket 4. In addition, the cartridges 1 are fixed to the bottom of the bracket 4 through 3 fixing devices 3. Other components and connection relations are the same as those of the first embodiment.

Embodiment 4

A housing 2 of the present embodiment is provided with 20 cartridges 1 and 20 fixing holes are provided on a bracket 4. In addition, the cartridges 1 are fixed to the bottom of the bracket 4 through 20 fixing devices 3. Other components and connection relations are the same as those of the first embodiment.

Embodiment 5

Compared with the first embodiment, a housing 2 of the present embodiment is made of die-casting aluminum. In addition, the structure of a bolt 3-3 and a bump 3-2 of a fixing device 3 is also different from the first embodiment. The bolt 3-3 in the present embodiment penetrates through the bottom of a cartridge 1 to be fixed with the cartridge 1 and the side wall of the bolt 3-3 is provided with a groove while the bump 3-2 fixedly connected on a rotation-stopping main body 3-1 may be provided on the side face of the rotation-stopping main body 3-1 to be embedded into the groove so as to realize a clamping purpose. The rotation-stopping main body 3-1 and the bottom of the bracket 4 are provided as an integral structure directly. Other components and connection relations are the same as those of the first embodiment.

Embodiment 6

Two fixed fire extinguishing apparatuses are used in combination in the present embodiment. The side wall of a housing 2 is provided with 3 installation holes. Two housings 2 are connected by a bolt. Components and connection relations in a housing 2 are the same as those of the first embodiment. The structures of fixed fire extinguishing apparatuses of the present invention are not limited to the embodiments above, and may be used independently or a plurality of them may be used in combination, specifically depending on a specific application environment.

The invention claimed is:

1. A fixed fire extinguishing apparatus, comprising:

a housing, cartridges and an activation controller connected to each of the cartridges, wherein the cartridges are formed in an array in the housing;

a bracket configured to support the cartridges is further provided in the housing; a top of the bracket is provided with a fixing holes matched with a structure of an outer wall of the cartridges; a bottom of each of the cartridges penetrates through the fixing holes and extends to a bottom of the bracket;

a counter bore at a top of the housing; a spraying end of each of the cartridges extends into the counter bore; the bottom of each cartridge is fixedly connected with the bracket through a plurality of fixing devices which are connected;

the plurality of fixing devices comprise a bolt fixed at the bottom of each of the cartridges, a nut matched with the bolt, a rotation-stopping main body that is clamped directly to the bottom of the bracket and a bump fixed on the rotation-stopping main body and clamped with the bolt;

a through groove is provided on the bolt, a through-direction of the through groove is perpendicular to an extending direction of an axis of the bolt; the bump is embedded in the through groove to prevent rotation.

2. The fixed fire extinguishing apparatus according to claim 1, wherein the rotation-stopping main body is integrated with the bottom of the bracket.

3. The fixed fire extinguishing apparatus according to claim 1, wherein a spraying window may be further provided at a front side wall of the housing; a filter net is provided on the spraying window; a deflecting plate extending to the spraying window is provided above the spraying end of the cartridge.

4. The fixed fire extinguishing apparatus according to claim 3, wherein the outer wall of the cartridge is fixedly connected with the bracket by filling a silica gel liquid.

5. The fixed fire extinguishing apparatus according to claim 1, wherein the activation controller is provided at a bottom of the housing and connected with an ignition head of the cartridge through a conductor.

6. The fixed fire extinguishing apparatus according to claim 5, wherein a side wall of the bottom end of the housing is provided with a moveable gate the moveable gate faces the activation controller in the housing.

7. The fixed fire extinguishing apparatus according to claim 1, wherein there are 3 to 20 cartridges.

* * * * *